United States Patent [19]

Wolber

[11] 3,945,192

[45] Mar. 23, 1976

[54] GEAR ENCLOSURE FOR CLOCKS

[75] Inventor: Robert Wolber, Lauterbach, Germany

[73] Assignee: Gebruder Junghans GmbH, Schramberg, Wurtt., Germany

[22] Filed: Sept. 25, 1974

[21] Appl. No.: 509,316

[30] Foreign Application Priority Data

Sept. 28, 1973 Germany ..... 35107[U]

[52] U.S. Cl. ..... 58/7; 58/52 R; 58/55; 58/107

[51] Int. Cl.[2] ..... G04B 13/02; G04B 29/02; G04B 37/00

[58] Field of Search ..... 58/23 D, 7, 52–55, 58/104, 2

[56] References Cited

UNITED STATES PATENTS

| | | | |
|---|---|---|---|
| 2,491,453 | 12/1949 | Knobel | 58/53 X |
| 2,618,118 | 11/1952 | Harris et al. | 58/104 X |
| 2,700,272 | 1/1955 | Trichel | 58/53 |
| 3,603,074 | 9/1971 | Ganter et al. | 58/7 |
| 3,837,160 | 9/1974 | Hettich | 58/55 |

*Primary Examiner*—Edith Simmons Jackmon
*Attorney, Agent, or Firm*—Haseltine, Lake & Waters

[57] ABSTRACT

Gear drive enclosure, preferably for battery-operated clocks whose drive is supported in and on both sides of a single base plate, and wherein the latter has a plastic housing cover or capsule and a support plate coordinated thereto. The plastic capsule limits one side of the gear mechanism, which has an indicator mechanism provided thereat, while the support plate limits the other side of the gear mechanism.

6 Claims, 3 Drawing Figures

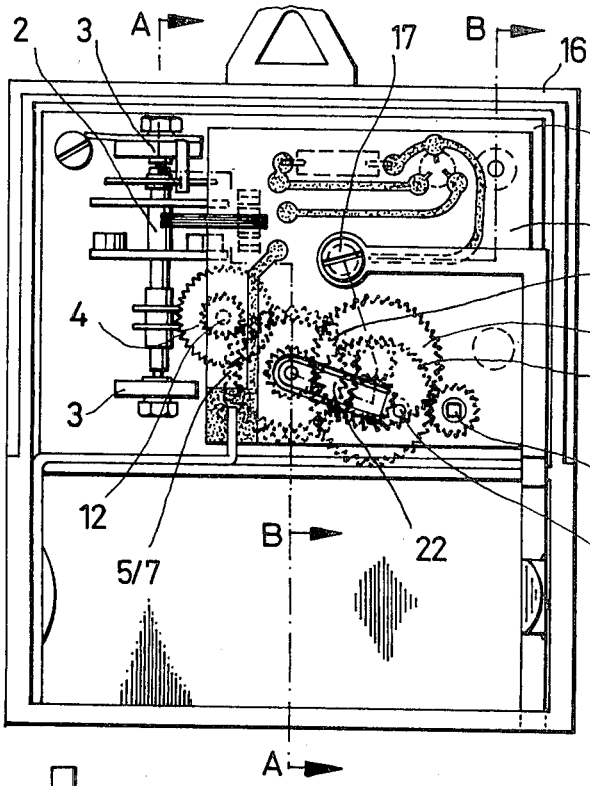
Fig. 1
Fig. 2
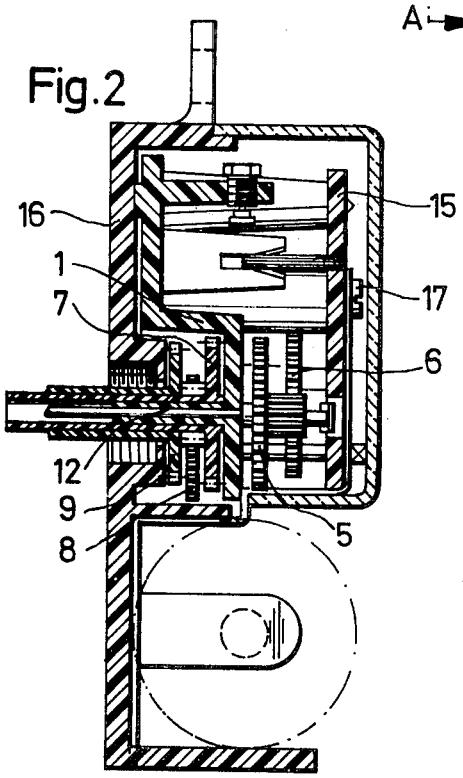
Fig. 3
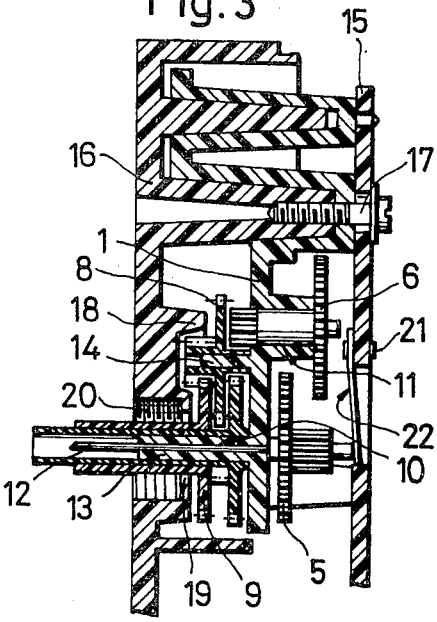

GEAR ENCLOSURE FOR CLOCKS

The present invention relates to a gear drive enclosure, preferably for a battery-operated clock whose gear drive is supported in and on both sides of a single base plate, and wherein the latter has a plastic housing cover or capsule and a support plate coordinated thereto.

From Swiss Pat. No. 334,217 it has become known to support a gear drive of a clock on a single base plate. The gears and drives in that case are located on both sides of the base plate and are interconnected by means of shaft ends so as to form respective gear components. In this manner the base plate alone can guide the gear drive also axially.

For assembly, the gears or drives must be individually pressed onto the shaft ends that are introduced into the guide holes of the base plate. This, however, is extremely uneconomical during assembly, as well as upon disassembly, if need be, such as for repair purposes.

From German Laid-Open Specification No. 1,523,847, it has become known that the gear drive may be supported by only a base plate constituted of plastic material. For this purpose, the base plate is provided with elongated bores or cylindrical hubs in which and/or on which the gear drive elements are guided.

The gear drive is similarly distributed to both sides of the base plate, namely so that the minute wheel together with the hour and change wheels is located on one side, and the remaining gears on the opposite side. Axially they are limited on the one side by the base plate itself, and on the other side by a bottom and also an auxiliary plate, wherein the first-named plate covers the plastic housing that encompasses the operative parts on the indicator mechanism side. This battery-operated clock in addition includes a support plate fastened to the base plate.

This type of support of the gear drive components is in general fully adequate for battery-operated clocks in view of the journaling forces, and provides a satisfactory cost-wise advantage. This however is reduced to a considerable extent by the additional plates.

Accordingly, it is an object of the present invention to provide a single-base-plate clock drive in which the aforementioned auxiliary and base plates are eliminated that enclose the gear drive.

The foregoing is inventively achieved in that the gear drive is limited on the indicator side by the plastic housing cover, and by the support plate on the gear-drive side.

In accordance with an exemplary embodiment of the invention, the limiting points or areas of the plastic housing cover are formed through inward or outward attachments, and such a point for the support plate is constituted in at least one plate through a leaf-spring fastened thereto.

By means of the newly inventive extended function of the plastic housing cover and of the support plate, the above-mentioned cost-wise advantage is not reduced, and moreover the assembly of the gear drive is substantially simplified as a result of the formation at the limiting positions of the plastic housing capsule.

This construction permits a pre-placement of the gear-drive elements, belonging to the indicator mechanism, with respect to the support positions of the base plate subsequently built into the plastic housing cover.

In this manner, the gear drive and base plate assembly may be accomplished in an extremely simple and rational manner within a single operating sequence.

The operating speed and quality are superior to those of assembly machines which latter tend to disturbances when plastic gear drives are assembled.

By means of a leaf spring pre-mounted on the gear side of the support plate there is achieved the further advantage that the prestressing of the spring is not dependent upon the tolerance of the plate thickness. Thus, there are achieved equal frictional conditions for various support plate types.

In a specific, exemplary embodiment of the invention a gear enclosure is provided for clocks which have a gear mechanism and an indicator mechanism associated therewith, the enclosure comprising a single base plate in and on both sides of which the gear mechanism is mounted; a plastic housing capsule for limiting one side of the gear mechanism, which has the indicator mechanism provided thereat; and a support plate associated and substantially parallel with the base plate, for limiting the other side of the gear mechanism.

According to further, optional features of the invention the plastic capsule may have on the one side at least one projection with at least one of the base plate and the support plate. The projection may be ring-shaped to surround a portion of one of the plates.

Also, the support plate may have thereon, namely on the other side, at least one leaf spring for outwardly biasing a portion of the indicator mechanism, thereby to prevent trembling thereof. The leaf spring preferably has an arm secured to the inner surface of the support plate, which faces the base plate.

Reference may now be had to the detailed description of an inventive, preferably battery-operated clock with a balancewheel mechanism, taken in conjunction with the accompanying drawing that shows an exemplary embodiment thereof, in which:

FIG. 1 is a plan view of a clock, taken toward its support plate side;

FIG. 2 is a section taken along line A—A in FIG. 1; and

FIG. 3 is a section taken along line B—B in FIG. 1.

Referring now to the drawing, a single base plate 1 made of a plastic material has journaled therein a balance wheel 2 by means of arms 3. The wheel 2 drives a gear mechanism consisting of a second gear 5, a small main gear 6, a minute gear 7, a change gear 8 and an hour gear 9, in the usual manner through the intermediary of a switching wheel 4. These gear-drive components are supported in a conventional manner in bores 10, 11 and on preferably cylindrical attachments 12, 13 and 14 of the plate 1.

Axial limitation of the gear-drive components is performed on both sides of the plate 1, in a new inventive manner for such a clock, a usual support plate 15 and a plastic housing capsule 16 being provided, after all three components are interconnected by means of a screw 17.

The limiting positions or points of the housing capsule 16 show preferably ring-like projections 18 and 19, serving for assembly purposes, the projections connecting to a usual central screw or thread 20.

Interiorly of the inner side of the plate 15 a leaf spring 22 assumes the axial limiting of the second shaft, fastened to plate 15 at a location 21, whereby at the same time trembling of the second pointer or hand is avoided.

A pointer setting shaft is designated by numeral 23, which is journaled in the plates 1 and 15.

In accordance with the above-mentioned inventive exemplary embodiment, the support plate 15 also has the purpose of supporting the pointer setting shaft 23 as well as the additional limiting of the gear drive, further to its inherent task of supporting and electrically connecting the electronic components of the clock.

However, it is also possible that the purpose of the plate 15 be increased in that it can also serve as a support, indirectly or directly, for other not illustrated components that can be attached from the inner and/or outer sides.

It may be understood by those skilled in the art that various modifications and changes can be made in the inventive gear enclosure without departing from the spirit and scope of the invention.

What is claimed is:

1. A gear enclosure for clocks having a gear mechanism and an associated indicator mechanism, the enclosure comprising, in combination: a single base plate in and on both sides of which said gear mechanism is mounted; a plastic housing capsule for limiting one side of said gear mechanism, which has said indicator mechanism provided thereat, and for both axially and radially guiding and journeling portions of said indicator mechanism; and a support plate associated and substantially parallel with said base plate, for limiting the other side of said gear mechanism.

2. The gear enclosure as defined in claim 1, wherein said plastic capsule has on said one side at least one projection in a limiting area of contact with at least one of said plates, said projection serving in part for the guiding of said portions of the indicator mechanism.

3. The gear enclosure as defined in claim 1, further comprising a common screw for interconnecting both said plates and said capsule upon final assembly of said mechanisms.

4. The gear enclosure as defined in claim 2, wherein said at least one projection is ring-shaped to surround at least one portion of said plates.

5. The gear enclosure as defined in claim 1, wherein said support plate has on said other side at least one leaf spring for outwardly biasing a portion of said indicator mechanism, thereby to prevent trembling thereof.

6. The gear enclosure as defined in claim 5, wherein said leaf spring has an arm secured to the inner surface of said support plate, which faces said base plate.

* * * * *